US008535083B1

(12) United States Patent
Gong et al.

(10) Patent No.: US 8,535,083 B1
(45) Date of Patent: Sep. 17, 2013

(54) LOCKING MECHANISM FOR CONNECTOR

(75) Inventors: Xin-Hu Gong, Shenzhen (CN); Ju-Wen Dai, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/488,457

(22) Filed: Jun. 5, 2012

(30) Foreign Application Priority Data

Mar. 14, 2012 (CN) ..... 2012 1 0066678

(51) Int. Cl.
*H01R 13/62* (2006.01)

(52) U.S. Cl.
USPC ..... 439/371

(58) Field of Classification Search
USPC ..... 439/133, 676, 541.5, 353, 354, 344, 439/371, 373
See application file for complete search history.

(56) References Cited

U.S. PATENT DOCUMENTS

| | | | | |
|---|---|---|---|---|
| 7,354,291 | B2 * | 4/2008 | Caveney et al. | 439/344 |
| 7,438,584 | B2 * | 10/2008 | Caveney et al. | 439/344 |
| 7,578,690 | B2 * | 8/2009 | Caveney et al. | 439/344 |
| 8,025,514 | B1 * | 9/2011 | Wang | 439/172 |
| 8,038,456 | B1 * | 10/2011 | Wang | 439/172 |
| 8,215,972 | B2 * | 7/2012 | Wang | 439/172 |
| 8,398,424 | B1 * | 3/2013 | Vasavda et al. | 439/371 |
| 2006/0046557 | A1 * | 3/2006 | Pulizzi et al. | 439/371 |
| 2013/0084731 | A1 * | 4/2013 | Gong et al. | 439/353 |

* cited by examiner

*Primary Examiner* — Neil Abrams
*Assistant Examiner* — Phuongchi T Nguyen
(74) *Attorney, Agent, or Firm* — Altis Law Group, Inc.

(57) ABSTRACT

A locking mechanism is used to lock a connector to an information handling device. The locking mechanism includes a supporting bracket, a locking member, and an attachment member sleeved on a cable extending from the connector and slidably coupled to the supporting bracket. The supporting bracket is cantilevered from the information handling device. The locking member is rotatably mounted to the supporting bracket, adjacent to a distal end of the supporting bracket. The locking member engages with the attachment member by rotating the locking member in a first direction, thereby locking the connector to the information handling device. The locking member disengages from the holding member by rotating the locking member in a second direction opposite to the first direction, thereby the attachment member is capable of moving away from the information handling device to release the connector from the information handling device.

13 Claims, 5 Drawing Sheets

LOCKING MECHANISM FOR CONNECTOR

BACKGROUND

1. Technical Field

The present disclosure relates to a locking mechanism for locking a connector to a device.

2. Description of Related Art

A peripheral device may be connected to a processing device through a cable and a connector. However, the connector tends to disengage from the processing device and causes the connection between the peripheral device and the processing device to be interrupted. Therefore, there is a risk of losing data, or even damaging the devices.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION OF THE DESCRIPTION

Figure 1:
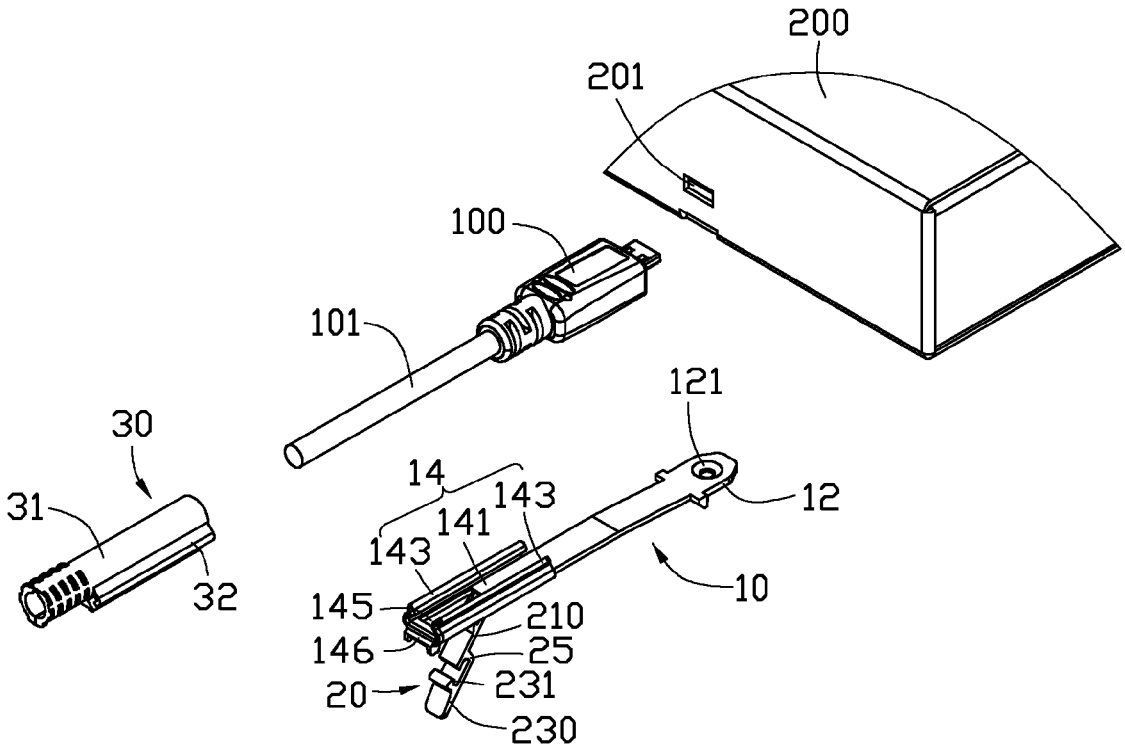
FIGS. 1 and 2 are exploded, isometric views of an embodiment of a locking mechanism, a connector, a cable extending from the connector, and an information handling device, viewed from different perspectives.
Figure 2:
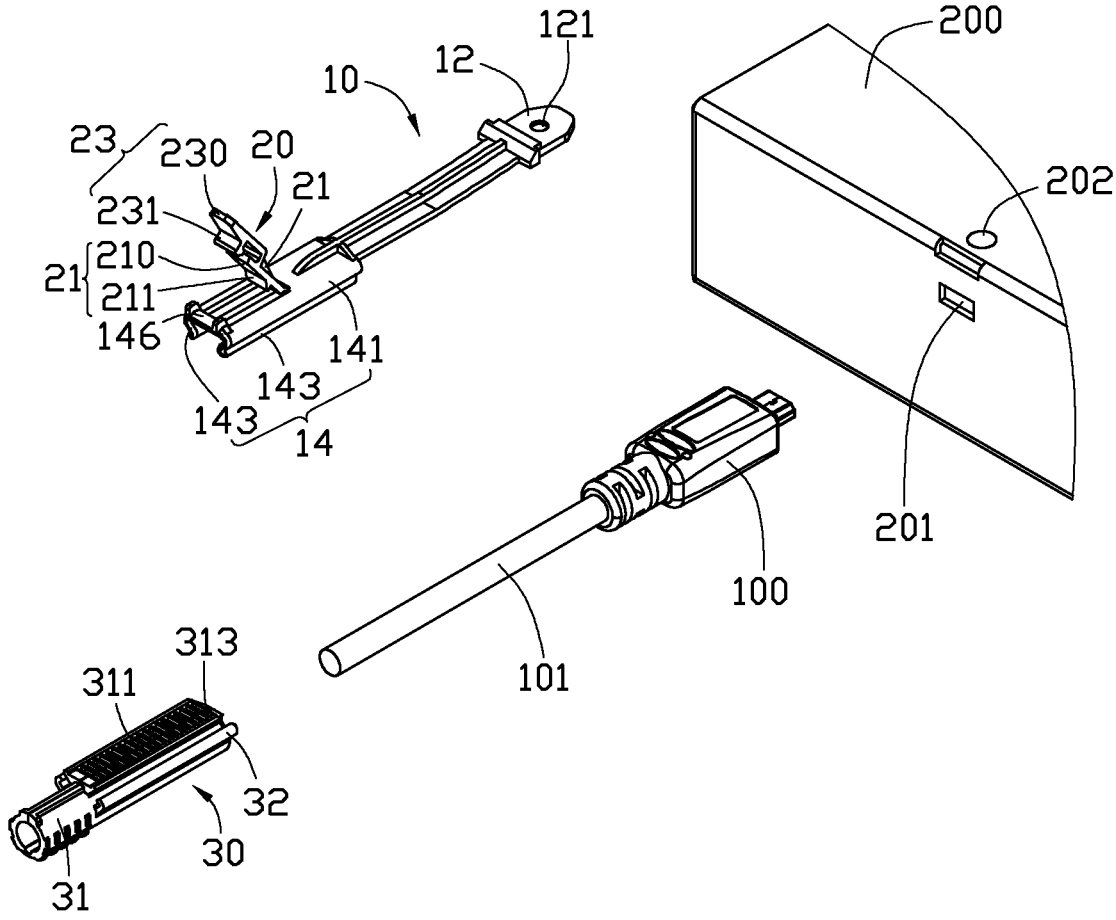

Referring to FIGS. 1 and 2, an embodiment of a locking mechanism which is used to lock a first connector 100 to an information handling device 200 is shown. A second connector 201 is formed on a front wall of the information handling device 200. A securing hole 202 is defined in a bottom wall of the information handling device 200, adjacent to the second connector 201. A cable 101 extends from the first connector 100. The locking mechanism includes a supporting bracket 10, a locking member 20, and an attachment member 30.

The supporting bracket 10 is long and thin, and includes a mounting portion 12 and a coupling portion 14 formed on opposite ends of the supporting bracket 10. The mounting portion 12 defines a mounting hole 121. The coupling portion 14 is substantially U-shaped in cross section, and includes a base wall 141, and holding walls 143 extending up from opposite sides of the base wall 141 and slightly slanting toward each other. An opening 145 is defined in the base wall 141. A locking tab 146 protrudes from the base wall 145, and is arranged at a side of the opening 145 far away from the mounting portion 12.

The locking member 20 includes a locking portion 21, a manipulation portion 23, and a connection portion 25 connected between the locking portion 21 and manipulation portion 23. The locking portion 21 includes a first board 210, and a wedge-shaped engagement tab 211 extending from the first board 210 and facing the supporting bracket 10. The manipulation portion 23 includes a second board 230 parallel to the first board 210, and a stopping hook 231 extending from the second board 230 and facing the supporting bracket 10. A first end of the first board 210 is rotatably connected to a sidewall bounding the opening 145 opposite to the locking tab 146. The connection portion 25 is perpendicularly connected between a second end of the first board 210 opposite to the first end and the second board 230.

The attachment member 30 is made of resilient material, such as rubber or plastic, and includes a cylindrical body 31, and two opposite guide walls 32 extending from the cylindrical body 31. The guide walls 32 extend along a direction parallel to the axial direction of the cylindrical body 31, and each has an L-shaped cross section. A rack 311 with gear teeth is formed on a bottom of the outside of the cylindrical body 31, extending along the direction parallel to the axial direction of the cylindrical body 31, and is arranged between the guide walls 32. A division cut 313 is defined in the cylindrical body 31, extending along the direction parallel to the axial direction of the cylindrical body 31 and extending through a middle of the rack 311, to enable the cylindrical body 31 to be opened for accessing of the cable 101.

Figure 3:
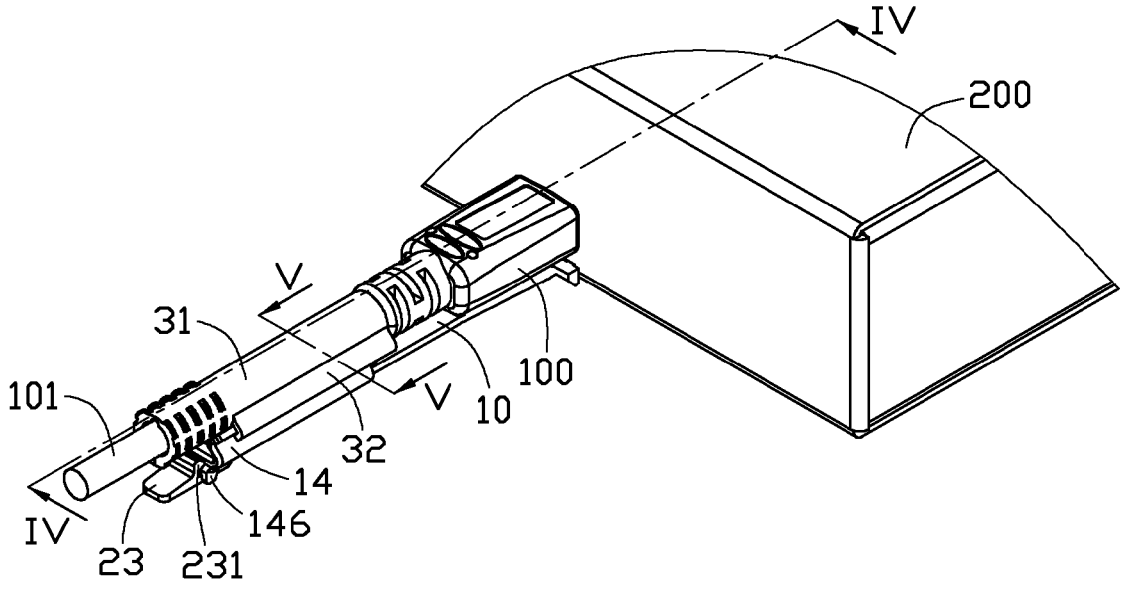
FIG. 3 is an assembled view of the items of FIG. 1.
Figure 4:
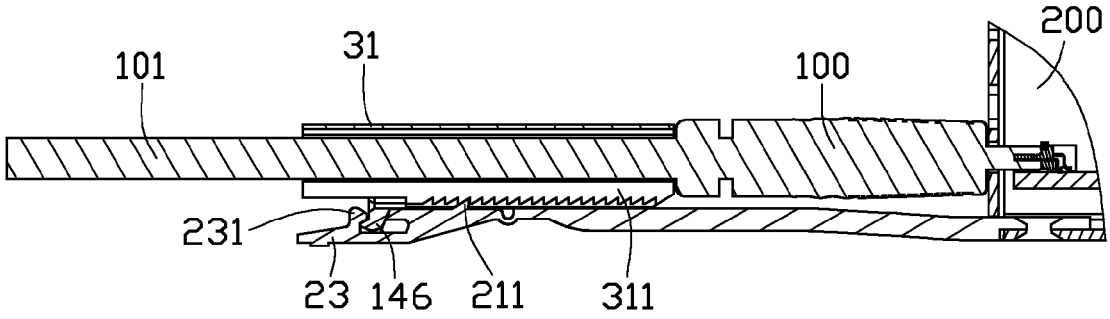
FIG. 4 is a sectional view taken along the line of IV-IV of FIG. 3.
Figure 5:
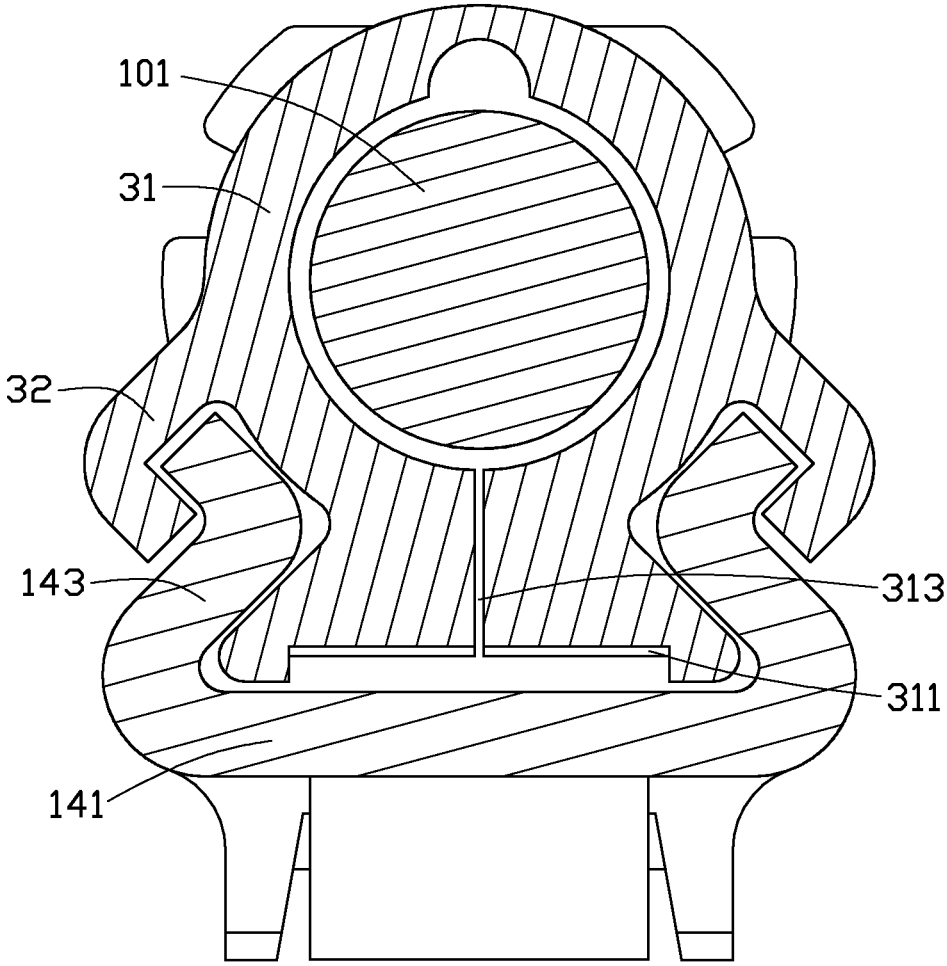
FIG. 5 is a sectional view taken along the line of V-V of FIG. 3.

Referring to FIGS. 3-5, in assembly, the supporting bracket 10 is fixed to the information handling device 200 with a fastener, such as a screw or a rivet, extending through the mounting hole 121 of the support bracket 10 and secured in the securing hole 202 of the information handling device 200. The coupling portion 14 of the support bracket 10 is located in front of the information handling device 200. The cylindrical body 31 is sleeved on the cable 101 and abuts the first connector 100.

The first connector 100 is coupled to the second connector 201 of the information handling system 201. The attachment member 30 is engaged with the coupling portion 14, with the two holding walls 143 of the coupling portion 14 slidably received between the guide walls 32 and the cylindrical body 31. The attachment member 30 encloses the rack 311 of the attachment member 30 to prevent the cable 101 from disengaging from the cylindrical body 31. The rack 311 is aligned with the opening 145 of the coupling portion 14. The locking member 20 is rotated towards the coupling portion 14 to a locking position, where the engagement tab 211 extends through the opening 145 and engages with the rack 311 to prevent the first connector 100 from disengaging from the second connector 201. At the same time, the stopping hook 231 engages with the locking tab 146 of the supporting bracket 10 to stop the locking member 20 from rotating away from the coupling portion 14.

To detach the first connector 100 from the information handling device 200, the manipulation portion 23 of the locking member 20 is twisted to force the stopping hook 231 away from the locking tab 146 of the supporting bracket 10 and rotate the locking member 20 away from the coupling portion 14 into a releasing position, where the engagement tab 211 disengages from the rack 311 to enable the first connector 100 to move with the attachment member 30 away from the information handling device 200.

It is to be understood, however, that even though numerous characteristics and advantages of the present disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A locking mechanism to lock a connector to an information handling device, the connector having a cable extending therefrom, the locking mechanism comprising:

a supporting bracket comprising a first end fixed to the information handling device and a second end extending away from the information handling device;

an attachment member attached to the cable, and abutting against the connector, the attachment member slidably mounted to the supporting bracket; and a locking member connected to the supporting bracket, and rotatable relative to the supporting bracket between a locking position where the locking member engages with the attachment member, thereby preventing the connector from disengaging from the information handling device, and a releasing position where the locking member disengages from the attachment member, thereby the connector being capable of moving away from the information handling device.

2. The locking mechanism of claim 1, wherein the supporting bracket comprises a coupling portion formed at the second end of the supporting bracket, the coupling portion defines a substantially U-shaped cross section, and comprises a base wall, and two holding walls respectively extending up from opposite sides of the base wall, the attachment member comprises a cylindrical body sleeved on the cable and two guide walls slidably engaged with the corresponding holding walls.

3. The locking mechanism of claim 2, wherein the guide walls of the attachment member each define an L-shaped cross section, the holding walls of the coupling portion are slidably received between the corresponding guide walls and the cylindrical body.

4. The locking mechanism of claim 2, wherein a rack with gears is formed on the outside of the cylindrical body, the locking member comprises an engagement tab to engage with the rack in response to the locking member in the locking position.

5. The locking mechanism of claim 4, wherein the rack extends along a direction parallel to an axis direction of the cylindrical body.

6. The locking mechanism of claim 4, wherein the rack is arranged between the guide walls, the base wall of the coupling portion defines an opening aligning with the rack, the engagement tab of the locking member extends through the opening to engage with the rack in response to the locking member in the locking position.

7. The locking mechanism of claim 6, wherein a locking tab extends from the base wall adjacent to the opening, the locking member further comprises a stopping hook, the stopping hook is fixed to the locking tab in response to the locking member in the locking position.

8. The locking mechanism of claim 4, wherein the holding walls are slanting toward each other, a division cut is defined in the cylindrical body along a direction parallel to an axis direction of the cylindrical body for accessing of the cable of the connector, the division cut extends through a middle of the rack, the rack is enclosed by the holding walls of the coupling portion.

9. The locking mechanism of claim 8, wherein the attachment member is made of resilient material.

10. A system, comprising:

an information handling device;

a connector electrically coupled to the handling device;

a cable extending from an end of the connector away from the information handle device;

a supporting bracket cantilevered from the handling device;

an attachment member attached to the cable, abutting against the end of the connector, and slidably mounted to the supporting bracket; and a locking member connected to the supporting bracket, adjacent to a distal end of the supporting bracket opposite to the handling device, and rotatable relative to the supporting bracket between a locking position where the locking member engages with the attachment member, thereby preventing the attachment member from moving away from the information handling device, and a releasing position where the locking member disengages from the attachment member, thereby the attachment member capable of moving away from the information handling device.

11. The system of claim 10, wherein the attachment member comprises a cylindrical body sleeved on the cable and a rack with gears protruding from an outside of the cylindrical body, the locking member comprises a locking portion, the locking portion comprises a first board, and an engagement tab extending from the first board to engage with the rack in response to the locking member in the locking position.

12. The system of claim 11, wherein the supporting bracket comprises a locking tab, the locking member comprises a manipulation portion, the locking portion comprises a second board parallel to the first board of the locking portion, and a stopping hook extending from the second board to be locked to the locking tab in response to the locking member in the locking position.

13. The system of claim 12, wherein the locking member defines an opening adjacent to the locking tab, the opening aligns with the rack of the attachment member, the engagement tab of the locking member extends through the opening of the attachment member to engage with the rack.

* * * * *